United States Patent [19]

Allen

[11] 4,341,923

[45] Jul. 27, 1982

[54] COATED ASBESTOS INSULATION TRANSFORMER WIRES

[75] Inventor: Benjamin F. Allen, Rome, Ga.

[73] Assignee: General Electric Company, New York, N.Y.

[21] Appl. No.: 196,669

[22] Filed: Oct. 14, 1980

[51] Int. Cl.[3] ..... H01B 7/08

[52] U.S. Cl. ..... 174/117 R; 174/119 R; 174/121 R; 174/124 R

[58] Field of Search ..... 174/119 R, 121 R, 34, 174/117 R, 120 R, 124 R, 124 GC, 122 R

[56] References Cited

U.S. PATENT DOCUMENTS 803,816 11/1905 Emmet ..... 174/121 R
1,956,951 5/1934 Hinsky ..... 174/121 R
2,674,648 4/1954 Nicodemus ..... 174/121 R
3,312,774 4/1967 Peterson ..... 174/121 R
4,204,087 5/1980 Lin ..... 174/119 R X

FOREIGN PATENT DOCUMENTS 690954 4/1953 United Kingdom ..... 174/121

*Primary Examiner*—Richard R. Kucia
*Attorney, Agent, or Firm*—Robert A. Cahill

[57] ABSTRACT

An electrically insulating coating for transformer wire consists of an asbestos paper coated with a plurality of strips of resin material. The resin material provides strength and toughness to the asbestos as well as abrasion resistance to the coated wire to protect the asbestos material during the coil winding process.

2 Claims, 3 Drawing Figures

COATED ASBESTOS INSULATION TRANSFORMER WIRES

BACKGROUND OF THE INVENTION

Transformer wires when used within dry type transformers generally comprise at least one rectangular wire covered first with a layer of thin asbestos paper followed by a covering of synthetic fibre material for toughness. The covered wire is then provided with a varnish overcoat to give further mechanical protection and abrasion resistance when the covered wire is wound into a transformer coil.

The inherent weak mechanical properties of the asbestos paper require the use of the fibre to keep the asbestos from tearing and exposing the rectangular wire. The varnish overcoat is needed to provide the necessary degree of abrasion resistance to the coated wire so that the coated wire can be passed through guides in the coil making process without catching and tearing the asbestos and fibre coating.

The use of the synthetic strengthening fibre and the provision of a varnish overcoat contributes to the material expenses involved in transformer manufacture. The purpose of this invention is to provide an asbestos paper insulation that has the required degree of toughness and lubricity to withstand the coil winding process without the synthetic fibre and varnish overcoat.

SUMMARY OF THE INVENTION

Asbestos transformer wire insulating paper is provided with a plurality of spaced resin strips coated or rolled onto the surface of the paper. The resin strips greatly improve the toughness of the paper while providing a high degree of lubricity to the asbestos surface.

DESCRIPTIION OF THE PREFERRED EMBODIMENT

Figure 1:
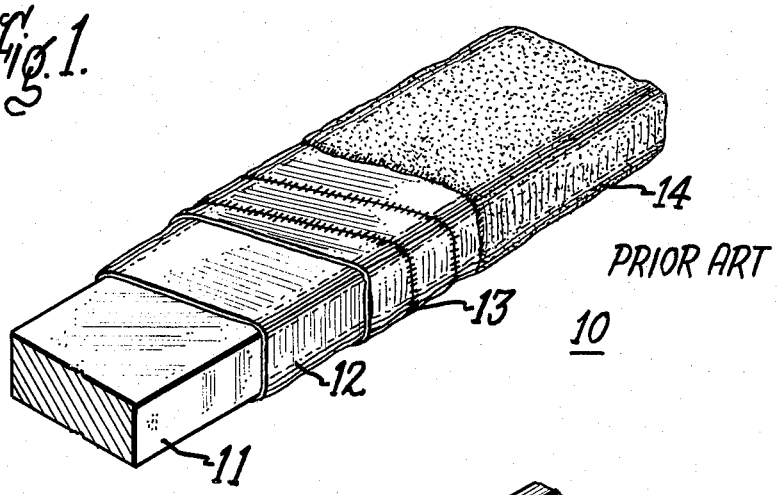
FIG. 1 is a top perspective view of a covered transformer wire in accordance with the prior art.

FIG. 1 shows a rectangular transformer wire 11 used in forming transformer windings and containing a wrapping of asbestos insulating paper 12 for electrically insulating wire 11 and further containing a covering of a glass fibre or a Nomex fibre 13. "Nomex" is a Dupont trademark for a heat resistant nylon. The covering of fibre material is required because of the low resistance to abrasion and tearing when asbestos paper 12 alone is used. Nomex is generally preferred to the glass fibres because of the skin irritation problems involved in contact with glass fibres. A varnish overcoat 14 is then provided over asbestos paper 12 and fibre 13 in order to protect both the asbestos paper 12 and the fibre 13 and to increase the abrasion resistance of the outer surface of covered wire 10. The presence of varnish overcoat 14 is desirable when covered wire 10 is drawn around a winding cylinder and must pass through a plurality of guides used in the coil winding operation.

Figure 2:
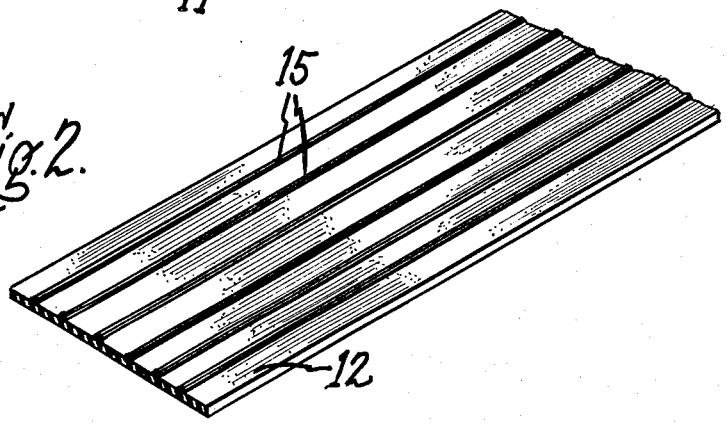
FIG. 2 is a top perspective view of the resin coated asbestos insulating paper of the instant invention.

The invention proposes the addition of a plurality of resin strips 15 coated onto the outer surface of asbestos insulating paper 12 as shown in FIG. 2. The resin can consist of any curable synthetic material, such as a flexible epoxy, which will provide strength to the asbestos paper 12 and also provide a high degree of lubricity to the outer surface of insulating paper 12. The resin strips 15 can comprise a plurality of parallel lines of resin material spaced approximately $\frac{1}{4}''$ apart and having a width of approximately $\frac{1}{8}''$. Other configurations for resin strips 15, such as diagonals, or diamond shapes can also be employed. The strips can be applied by roll coating or from a plurality of closely spaced coating guns which can be stationary while the asbestos insulating paper is drawn beneath the nozzle of the coating guns.

Figure 3:
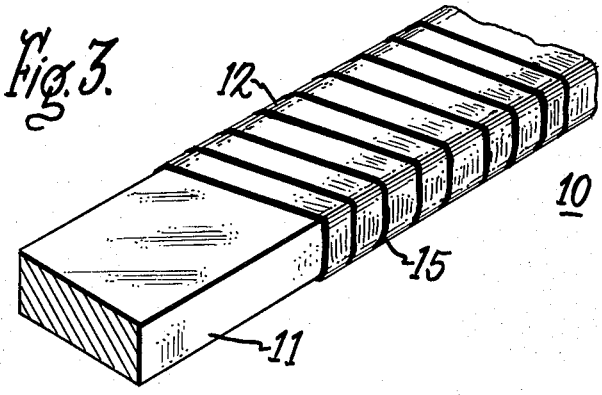
FIG. 3 is a top perspective view of a transformer wire wrapped with the resin coated asbestos shown in FIG. 2.

A covered transformer wire 10 consisting of a rectangular metal wire 11 and wrapped with insulating paper 12 is shown in FIG. 3 and contains a plurality of resin strips 15 on the outer surface of asbestos paper 12. Resin strips 15 extend sufficiently above the surface of asbestos insulating paper 12 to render the outer surface of coated wire 10 sufficiently slidable to allow coated wire 10 to be wrapped around a winding cylinder without causing the asbestos paper 12 to become torn. Asbestos paper 12 is known to possess a high degree of friction and makes the asbestos insulated transformer wire susceptable to tearing in the usual transformer coil winding operation. Spaces between the individual strips 15 allow treating resins such as silicone resin to impregnate the asbestos paper 12 when a transformer winding containing the coated transformer wire 10 of FIG. 3 is arranged around a winding cylinder to form a transformer coil and the coil is subsequently impregnated with a resin as is generally employed in the transformer industry.

What I claim as new and desire to secure by Letters Patent of the United States is:

1. An insulated transformer wire comprising:

a rectangular metal conductor; an a continuous wrapping of insulating paper containing a plurality of permanent strips of a heat curable resin adhered to and extending above the surface of said paper for the protection of said paper and the lubricity of the wire during a coil winding process.

2. The transformer wires of claim 1 wherein said resin comprises a flexible epoxy.

* * * * *